United States Patent [19]

Guse et al.

[11] Patent Number: 4,497,086

[45] Date of Patent: Feb. 5, 1985

[54] REGULATING METHOD AND SYSTEM FOR PRODUCING A UNIFORM SLIVER IN A CARDING MACHINE

[75] Inventors: Rolf Guse, Reutlingen; Norbert Tauber, Eningen, both of Fed. Rep. of Germany

[73] Assignee: Trützschler GmbH & Co. KG, Monchen-Gladbach, Fed. Rep. of Germany

[21] Appl. No.: 437,163

[22] Filed: Oct. 27, 1982

[30] Foreign Application Priority Data

Oct. 31, 1981 [DE] Fed. Rep. of Germany ..... 3143285

[51] Int. Cl.[3] ..... D01G 15/40; D01G 15/48; D01H 5/42

[52] U.S. Cl. ..... 19/105; 19/106 R; 19/240

[58] Field of Search ..... 19/105, 106 R, 240; 364/470

[56] References Cited

U.S. PATENT DOCUMENTS

| | | | |
|---|---|---|---|
| 3,141,202 | 7/1964 | Linnert et al. . | |
| 4,075,739 | 2/1978 | Staheli | 19/240 |
| 4,161,052 | 7/1979 | Erben | 19/105 X |
| 4,271,565 | 6/1981 | Grunder | 19/106 R |
| 4,393,547 | 7/1983 | Hösel | 19/105 |

FOREIGN PATENT DOCUMENTS

| | | |
|---|---|---|
| 313122 | 2/1974 | Austria . |
| 831378 | 2/1952 | Fed. Rep. of Germany . |
| 1265631 | 4/1968 | Fed. Rep. of Germany . |
| 2164011 | 6/1972 | Fed. Rep. of Germany . |
| 2912576 | 7/1982 | Fed. Rep. of Germany . |

*Primary Examiner*—Louis K. Rimrodt
*Attorney, Agent, or Firm*—Spencer & Frank

[57] ABSTRACT

A regulating apparatus for obtaining a uniform sliver delivered by a carding machine includes an rpm setter connected to a roller drive of the carding machine for determining an operational speed for the drive, a signal generator for producing a first signal as a function of actual properties of the sliver and a PI-regulator having a component determining a regulating time constant. The PI-regulator is connected to the signal generator for receiving the first signal and for generating a second, regulating signal. Further, the PI-regulator is connected to the drive for applying the second signal thereto. A regulating time constant setter is operatively connected to the component which determines a regulating time constant. The rpm setter and the regulating time constant setter cooperate for adjusting the regulating time constant setter as a function of adjustments of the rpm setter, whereby the regulating time constant of the PI-regulator is varied as a function of the rpm of the fiber-engaging roller.

14 Claims, 5 Drawing Figures

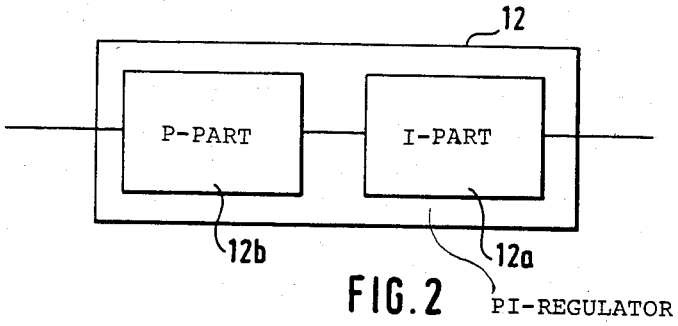
FIG. 2
FIG. 3
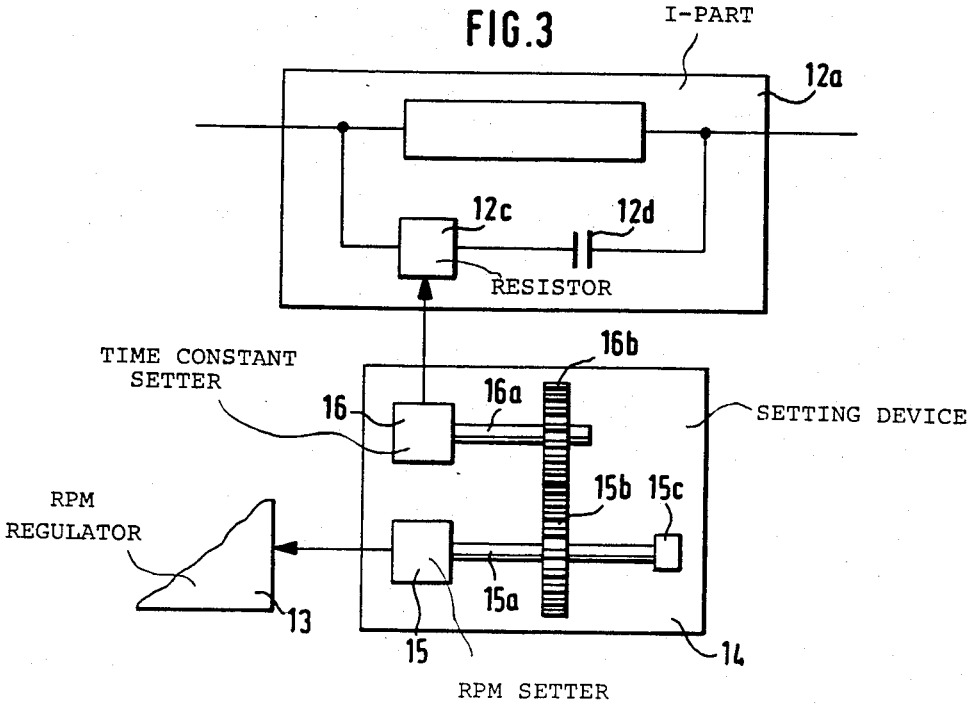

REGULATING METHOD AND SYSTEM FOR PRODUCING A UNIFORM SLIVER IN A CARDING MACHINE

BACKGROUND OF THE INVENTION

This invention relates to a regulating method and a regulating system for producing a uniform sliver in a carding machine, wherein a deviation of actual values from desired values is determined and a signal, representing the deviation is, with the intermediary of a regulator, applied to a drive which varies the rpm of at least one carding roller as a function of the signal magnitude.

In known processes of the above-outlined type the difficulty has been encountered that in case the operational speed of the carding machine is altered, that is, the rpm of the rollers is increased or decreased, the time behavior of the regulated system also varies. In particular, the delay of response of the regulating circuit is speed-dependent. By changing the speed of the carding machine, the speed of the fiber material supplied to, and/or the speed of the fiber material delivered by the carding machine changes to that the uniformity (cross section and weight) of the sliver delivered by the carding machine has been adversely affected.

SUMMARY OF THE INVENTION

It is an object of the invention to provide an improved method and system of the above-outlined type from which the discussed disadvantages are eliminated and which, even in case of machine speed variations ensures the production of an optimally uniform sliver.

This object and others to become apparent as the specification progresses, are accomplished by the invention, according to which, briefly stated, the carding machine uses a PI-regulator (proportional/integral regulator) in which the regulating time constant of the regulator is varied as a function of the output speed and/or the input speed of the fiber material.

By changing the regulating time constants of the regulator upon changing the carding speed, the time behavior of the regulated system can be adapted to the changed machine speed. This ensures an optimally uniform sliver irrespective of an increase or decrease of the rpm of the carding rollers.

In the regulating system according to the invention the rpm setter (rpm pre-selection for the basic rpm of a roller in the carding machine) cooperates with a setter which sets the regulating time constants of the PI-regulator. The rpm setter is preferably a potentiometer having linear characteristics. The time constant setter is preferably a potentiometer with non-linear, for example, logarithmic characteristics.

According to a preferred embodiment of the invention, the rpm setter and the regulating time constant setter are coupled to one another, for example, mechanically (by means of gears or frictional wheels), electrically or electronically.

According to a further feature of the invention, the rpm setter is a tachogenerator which is associated with the drive motor for one of the carding rollers and to the output of which a transducer is preferably connected. According to a particularly advantageous feature of the invention, the time constant setter varies the I-part (integral part) of the PI-regulator by varying the resistance of an RC-component which determines the regulating time constant.

BRIEF DESCRIPTION OF THE DRAWINGS

FIG. 2 is a block diagram of a component of the regulating system of FIG. 1.

FIG. 3 is a block diagram of further components of the regulating system of FIG. 1.

DESCRIPTION OF THE PREFERRED EMBODIMENTS

Figure 1:
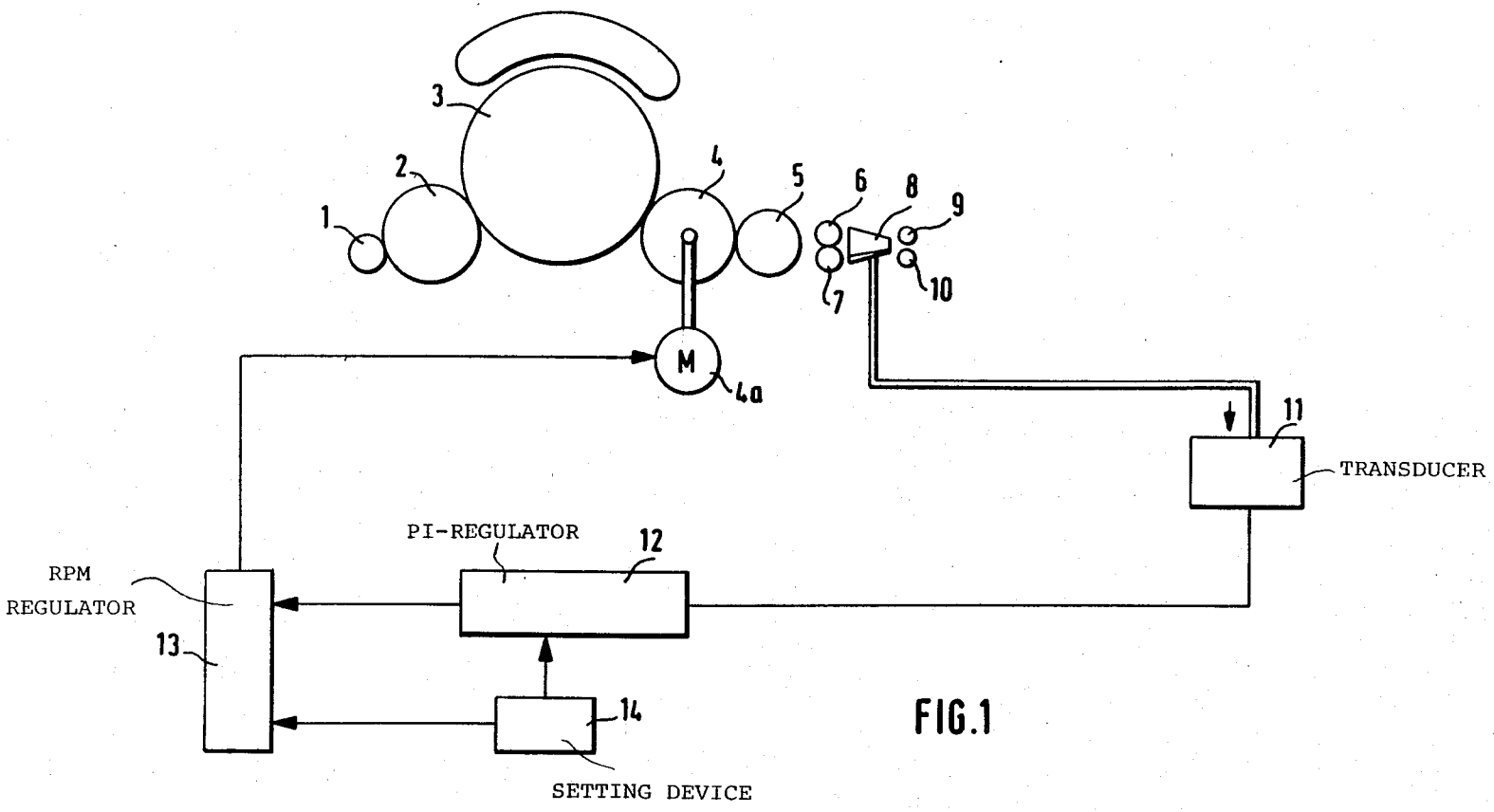
FIG. 1 is a schematic side elevation of a carding machine and a block diagram of a preferred embodiment of a regulating system associated with a carding machine.

Turning now to FIG. 1, there is schematically shown a carding machine having a feed roller 1, a lickerin 2, a carding cylinder 3, a doffer 4, a take-off roller 5, squeezing rollers 6 and 7, a trumpet 8 and calender rollers 9 and 10. With the trumpet 8 there is associated a sensor which pneumatically measures, in a known manner, properties of the cross section of the sliver passing through the trumpet 8. The pressure oscillations resulting from such sensing operation are converted by a transducer 11 (actual value transducer) into electric signals which are applied to a PI-regulator 12 (continuous regulator) which, as shown in FIG. 2, has an I-part 12*a* and a P-part 12*b*. To the output of the PI-regulator 12 there is connected an rpm regulator 13 such as a SIMOREG model to which, in turn, there is connected a drive motor 4*a* for the doffer 4. Outputs of a setting device 14 are connected to the PI-regulator 12 and the rpm regulator 13.

*)manufactured by SIEMENS AG, Munich (W. Germany)*)

Turning now to FIG. 3, the setting device 14 comprises an rpm setter 15 which may be, for example, a linear potentiometer electrically connected with the rpm regulator 13. The setting device 14 further has a setter 16 which may be a potentiometer with logarithmic characteristics and which is electrically connected with the I-portion 12*a* of the PI-regulator 12. The I-portion 12*a* has an RC component comprising a capacitor 12*d* and a resistor 12*c*. The latter is connected to the setter (potentiometer) 16. The potentiometer 15 has a shaft 15*a* which carries a gear 15*b* as well as a setting knob 15*c*. The potentiometer 16 has a shaft 16*a* on which there is mounted a gear 16*b*. The gears 15*b* and 16*b* are in a meshing relationship with one another so that, as a result, the potentiometers 15 and 16 are mechanically coupled to one another. In this manner the rpm setter 15 cooperates with the setter 16 whereby the latter sets the I-part 12*a* of the PI-regulator 12 and thus adjusts the regulating time constant as the rpm setting is changed. Thus, the potentiometer 15 serves for setting the machine speed, while with the aid of the potentiometer 16 the regulating time constant is varied by changing the resistance of the RC component. Since, as noted before, the potentiometer 15 for setting the rpm is a linear potentiometer, the resistance values change in direct proportion to the angular displacement of the shaft 15*a*. Further, the resistance values depend, in a good approximation, linearly from the rpm. The logarithm of the time constants is inversely proportional to the machine rpm. The same relationship prevails in the logarithmic potentiometer 16 between the angle of rotation of the shaft 16*a* and the set resistance values.

In order to maintain the desired dependence of the time constants from the sliver speed, the linear potentiometer 15 is coupled with the logarithmic potentiometer 16 whereby the linear potentiometer 15 serves for the setting of the sliver speed. Expediently, only a predetermined part of the setting angle of the logarithmic potentiometer 16 is utilized. For setting the time constants, the appropriate range of angular adjustment is to be set by selecting a certain transmission ratio between the potentiometers 15 and 16 and by setting the starting angle of rotation of the two potentiometers 15 and 16 with respect to one another. The selection of the total resistance range of the potentiometer determines the required capacitor in order to achieve the desired time constants for all speeds.

Figure 4:
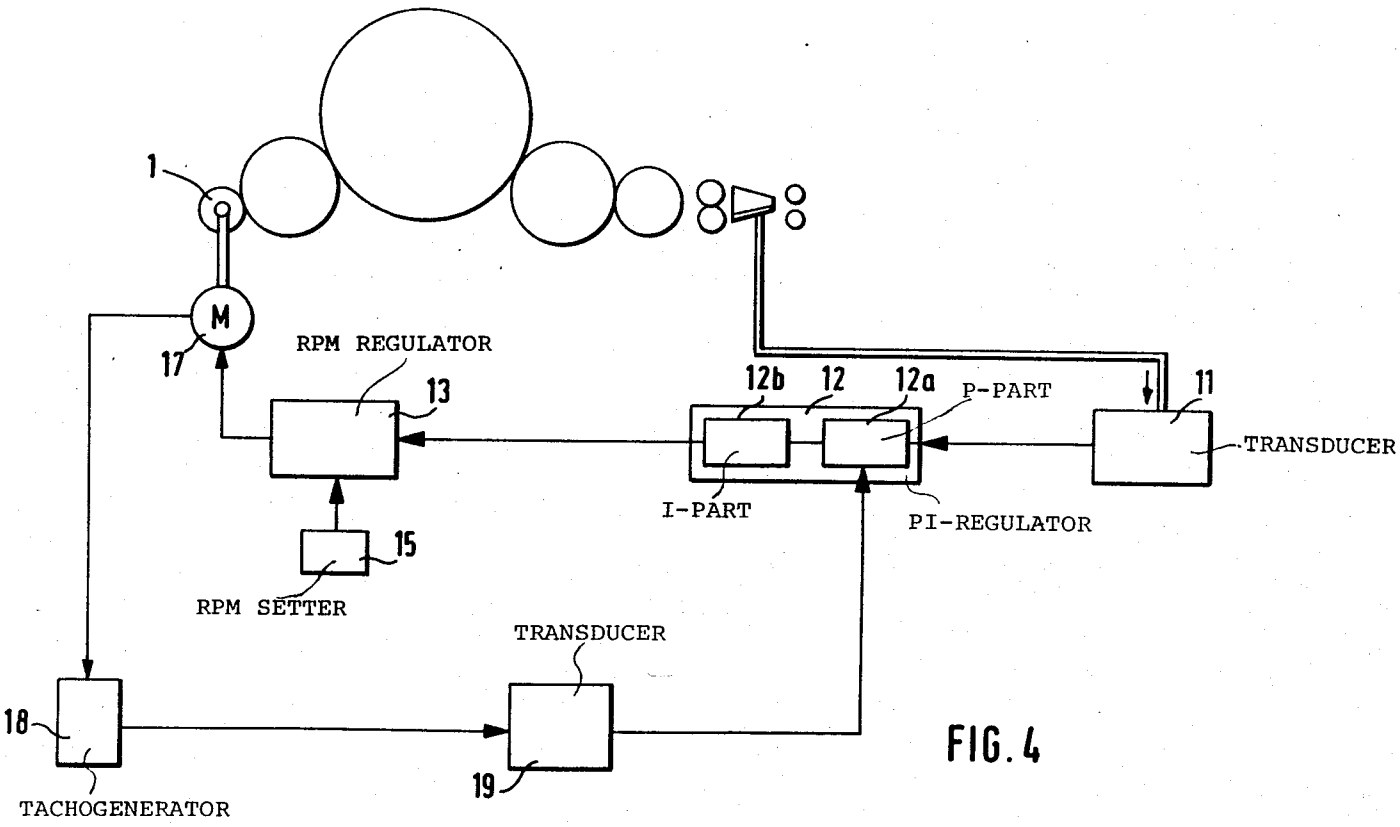
FIG. 4 is a schematic side elevation of a carding machine and a block diagram of another preferred embodiment of a regulating system according to the invention.

Turning now to FIG. 4, to the output of the PI-regulator 12 there is connected, similarly to FIG. 1, an rpm regulator 13 which, in turn, is coupled with an rpm setter 15 such as a potentiometer. The rpm setter 15 varies the rpm of the drive motor 17 for the feed roller 1. A tachogenerator 18 is coupled with the drive motor 17 to sense the rpm thereof. Signals from the tachogenerator 18 are applied to a transducer 19, whose electric signals, in turn, are applied to the I-part 12*b* of the PI-regulator 12.

Figure 5:
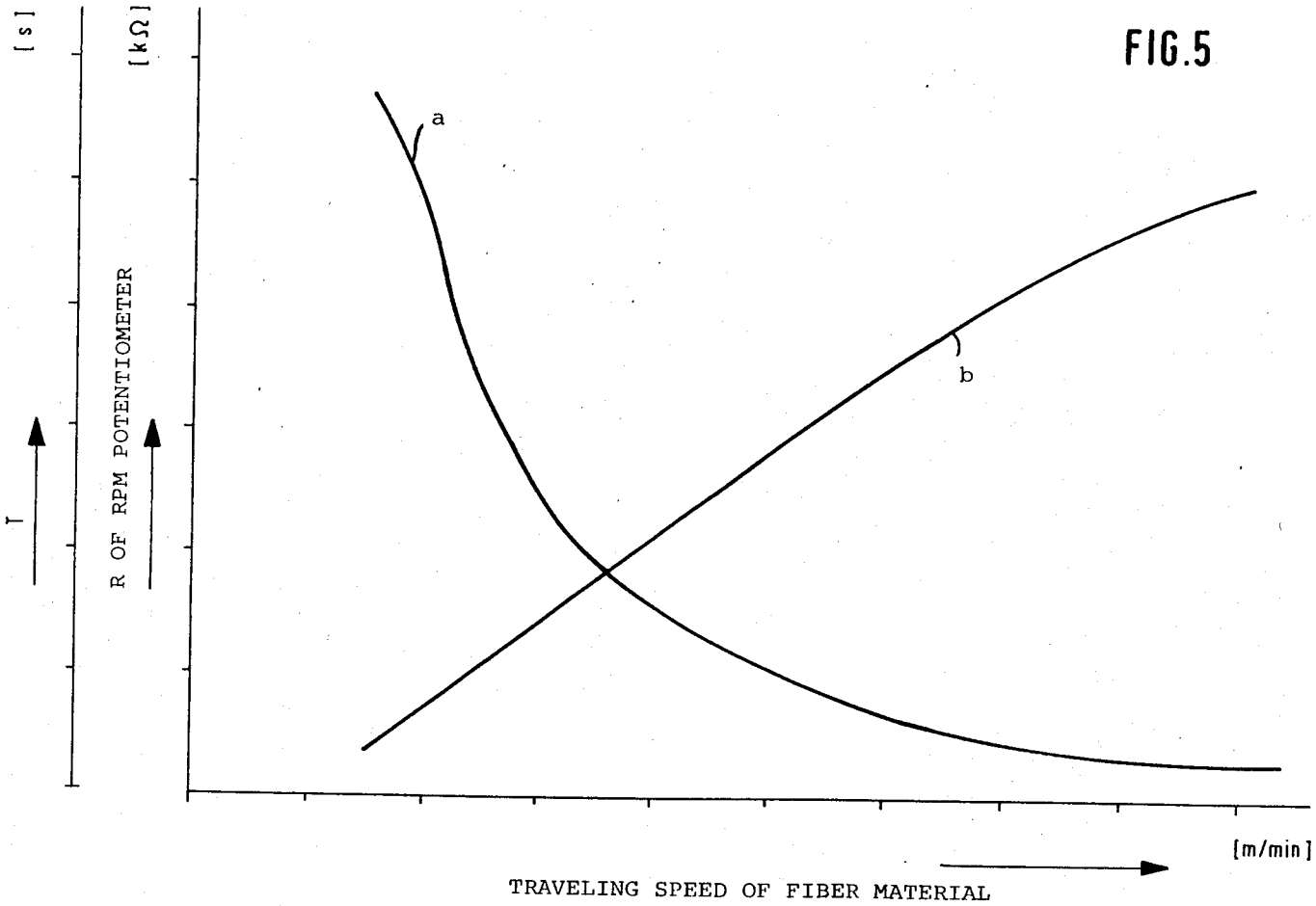
FIG. 5 is a diagram illustrating the regulating time constant of a PI-regulator and the resistance of an rpm potentiometer as a function of the traveling speed of the fiber material.

Turning now to FIG. 5, in the graph shown therein, curve a represents the time constant T as a function of the traveling speed of the fiber material and curve b represents the resistance of the rpm potentiometer as a function of the traveling speed of the fiber material.

Instead of measuring devices incorporated in the trumpet 18, there may be used other measuring instruments such as measuring rollers or the like. As a setting member, as an alternative to the doffer 4 or the feed roller 1, a feeding device (not shown) arranged upstream of the card may be used. Such setting member thus may be the drive for the delivery rollers in a feed chute of a fiber tuft feeding device supplying a fiber lap to the carding machine. Such a drive and delivery rollers are, for the purposes of the regulating system according to the invention, considered as forming part of the carding machine.

In case the starting speed of the carding machine is determined by an external fixed resistor rather than by the base rpm setter, then for the starting speed an external I-value with fixed magnitude is to be applied.

It will be understood that the above description of the present invention is susceptible to various modifications, changes and adaptations, and the same are intended to be comprehended within the meaning and range of equivalents of the appended claims.

What is claimed is:

1. A regulating method for obtaining a uniform sliver delivered by a carding machine having a drive, comprising the following steps:

(a) generating a signal representing a deviation of actual properties of the sliver from desired properties thereof;

(b) applying said signal by a PI-regulator to said drive for regulating said drive as a function of said deviation; said PI-regulator having a regulating time constant; and (c) varying the regulating time constant of said PI-regulator as a function of a traveling speed of fiber material in said carding machine.

2. A regulating apparatus for obtaining a uniform sliver delivered by a carding machine; the carding machine having a fiber-engaging roller and a drive therefor, comprising (a) an rpm setter operatively connected to said drive for determining an operational speed for said drive;

(b) signal generating means for producing a first signal as a function of actual properties of the sliver;

(c) a PI-regulator having means for determining a regulating time constant of said PI-regulator; said PI-regulator being operatively connected to said signal generating means for receiving said first signal and for generating a second, regulating signal; said PI-regulator being operatively connected to said drive for applying thereto said second signal;

(d) a regulating time constant setter operatively connected to said means for determining a regulating time constant; and (e) means for effecting cooperation between said rpm setter and said regulating time constant setter for adjusting said regulating time constant setter as a function of adjustments of said rpm setter, whereby the regulating time constant of said PI-regulator is varied as a function of the rpm of said fiber-engaging roller.

3. A regulating apparatus as defined in claim 2, wherein said rpm setter comprises a variable potentiometer having linear characteristics.

4. A regulating apparatus as defined in claim 2, wherein said regulating time constant setter comprises a variable potentiometer having non-linear characteristics.

5. A regulating apparatus as defined in claim 2, wherein said regulating time constant setter comprises a variable potentiometer having logarithmic characteristics.

6. A regulating apparatus as defined in claim 2, wherein said PI-regulator has an I-part including said means for determining a regulating time constant.

7. A regulating apparatus as defined in claim 2, wherein said means for determining a regulating time constant includes an RC component having a variable resistor; said regulating time constant setter being coupled to said variable resistor for varying the resistance of said RC component.

8. A regulating apparatus as defined in claim 2, wherein said means for effecting cooperation comprises coupling means connecting said rpm setter with said regulating time constant setter.

9. A regulating apparatus as defined in claim 8, wherein said coupling means includes means for electrically connecting said rpm setter with said regulating time constant setter.

10. A regulating apparatus as defined in claim 8, wherein said coupling means includes means for electronically connecting said rpm setter with said regulating time constant setter.

11. A regulating apparatus as defined in claim 8, wherein said rpm setter and said regulating time constant setter have respective rotary setting shafts; said coupling means comprises gears mounted on said shafts and meshing with one another for connecting said shafts together.

12. A regulating apparatus as defined in claim 8, wherein said coupling means includes means for mechanically connecting said rpm setter with said regulating time constant setter.

13. A regulating apparatus as defined in claim 2, wherein said drive is a rotary drive motor and further wherein said regulating time constant setter comprises a tachogenerator connected to said drive motor for responding to the rpm thereof.

14. A regulating apparatus as defined in claim 13, further comprising a transducer connected between said tachogenerator and said means for determining a regulating time constant.

* * * * *